US009715211B2

(12) United States Patent
Arata

(10) Patent No.: US 9,715,211 B2
(45) Date of Patent: Jul. 25, 2017

(54) IMAGE FORMING APPARATUS INCLUDING AIR BLOWER, AND SHEET GUIDE USED IN IMAGE FORMING APPARATUS

(71) Applicant: KYOCERA Document Solutions Inc., Osaka-shi, Osaka (JP)

(72) Inventor: Tatsuro Arata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/197,542

(22) Filed: Jun. 29, 2016

(65) Prior Publication Data

US 2017/0003648 A1 Jan. 5, 2017

(30) Foreign Application Priority Data

Jun. 30, 2015 (JP) ..... 2015-131855

(51) Int. Cl.
*G03G 15/00* (2006.01)
*G03G 21/20* (2006.01)
*G03G 21/16* (2006.01)

(52) U.S. Cl.
CPC ..... *G03G 21/206* (2013.01); *G03G 15/6529* (2013.01); *G03G 21/1666* (2013.01)

(58) Field of Classification Search
CPC ..... G03G 21/206; G03G 21/1666; G03G 15/6529
See application file for complete search history.

(56) References Cited

U.S. PATENT DOCUMENTS 5,063,416 A * 11/1991 Honda ..... B41J 15/06 226/24
5,493,377 A * 2/1996 Nishikawa ..... G03G 15/2028 399/322
5,510,827 A * 4/1996 Kubota ..... G03G 15/326 347/257
5,860,645 A * 1/1999 Tomura ..... B65H 3/5261 271/10.04
9,317,003 B2 * 4/2016 Tsuchiya ..... G03G 21/1647
2005/0275149 A1 * 12/2005 Kim ..... B65H 31/10 271/10.09
2007/0222144 A1 * 9/2007 Inui ..... B65H 9/166 271/291
2008/0259405 A1 * 10/2008 Nishikawa ..... H04N 1/0032 358/401
2010/0078875 A1 * 4/2010 Nishiyama ..... B65H 1/266 271/127

(Continued)

FOREIGN PATENT DOCUMENTS

JP 2000098858 A 4/2000

*Primary Examiner* — G. M. Hyder
(74) *Attorney, Agent, or Firm* — Alleman Hall Creasman & Tuttle LLP

(57) ABSTRACT

An image forming apparatus includes a laser scanning unit, an upper guide member, a plurality of reinforcing ribs, and an air blower. The upper guide member is provided below the laser scanning unit and forms an upper guide surface of a sheet conveyance path extending in a direction along a bottom surface of the laser scanning unit. The plurality of reinforcing ribs are provided on an upper surface of the upper guide member and extend in a predetermined direction. The air blower is configured to send air to a space between the plurality of adjacent reinforcing ribs.

11 Claims, 3 Drawing Sheets

(56) References Cited

U.S. PATENT DOCUMENTS

| | | | | |
|---|---|---|---|---|
| 2012/0256367 | A1* | 10/2012 | Matsushima | B65H 1/14 271/147 |
| 2013/0076850 | A1* | 3/2013 | Oki | B41J 2/471 347/224 |
| 2013/0336667 | A1* | 12/2013 | Watanabe | G03G 15/6555 399/23 |
| 2014/0219697 | A1* | 8/2014 | Murooka | G03G 15/6576 399/406 |
| 2015/0071691 | A1* | 3/2015 | Fujii | G03G 21/105 399/350 |
| 2015/0277333 | A1* | 10/2015 | Sato | G03G 15/6552 399/405 |
| 2015/0284201 | A1* | 10/2015 | Nishikawa | B65H 9/004 271/3.2 |
| 2016/0091833 | A1* | 3/2016 | Okamoto | G03G 15/657 399/316 |
| 2016/0257508 | A1* | 9/2016 | Nishiyama | B65H 3/0684 |
| 2016/0378059 | A1* | 12/2016 | Arata | G03G 21/206 399/92 |
| 2017/0090416 | A1* | 3/2017 | Arata | G03G 21/206 |

* cited by examiner

IMAGE FORMING APPARATUS INCLUDING AIR BLOWER, AND SHEET GUIDE USED IN IMAGE FORMING APPARATUS

INCORPORATION BY REFERENCE

This application is based upon and claims the benefit of priority from the corresponding Japanese Patent Application No. 2015-131855 filed on Jun. 30, 2015, the entire contents of which are incorporated herein by reference.

BACKGROUND

The present disclosure relates to an image forming apparatus including a laser scanning unit, and a sheet guide used in the image forming apparatus.

An image forming apparatus which forms an image on a print paper by electrophotography, such as a copying machine and a printer, is equipped with a laser scanning unit. The laser scanning unit includes a motor that drives a scanning member such as a polygon mirror. When the motor is driven, heat is generated from the motor, thereby increasing the temperature within the image forming apparatus. The increase in the temperature within the image forming apparatus causes a decrease in the flowability of a developer such as toner or a decrease in an electric charge amount of the toner, resulting in an image defect such as a decrease in developability or a decrease in density. Thus, hitherto, a mechanism is proposed in which an air duct is provided around the laser scanning unit and air is sent to the air duct by an air blower, thereby cooling the laser scanning unit and a peripheral area thereof.

SUMMARY

An image forming apparatus according to one aspect of the present disclosure includes a laser scanning unit, an upper guide member, a plurality of reinforcing ribs, and an air blower. The upper guide member is provided below the laser scanning unit and forms an upper guide surface of a sheet conveyance path extending in a direction along a bottom surface of the laser scanning unit. The plurality of reinforcing ribs are provided on an upper surface of the upper guide member and extend in a predetermined direction. The air blower is configured to send air to a space between the plurality of adjacent reinforcing ribs.

A sheet guide according to another aspect of the present disclosure includes a guide portion main body and a plurality of reinforcing ribs. The guide portion main body is provided within an image forming apparatus and below a laser scanning unit. The guide portion main body is a flat-plate-like member forming an upper guide surface of a sheet conveyance path extending in a direction along a bottom surface of the laser scanning unit. The plurality of reinforcing ribs are provided on an upper surface of the guide portion main body in a standing manner. The plurality of reinforcing ribs reinforce the guide portion main body and form an air passage extending in a predetermined direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
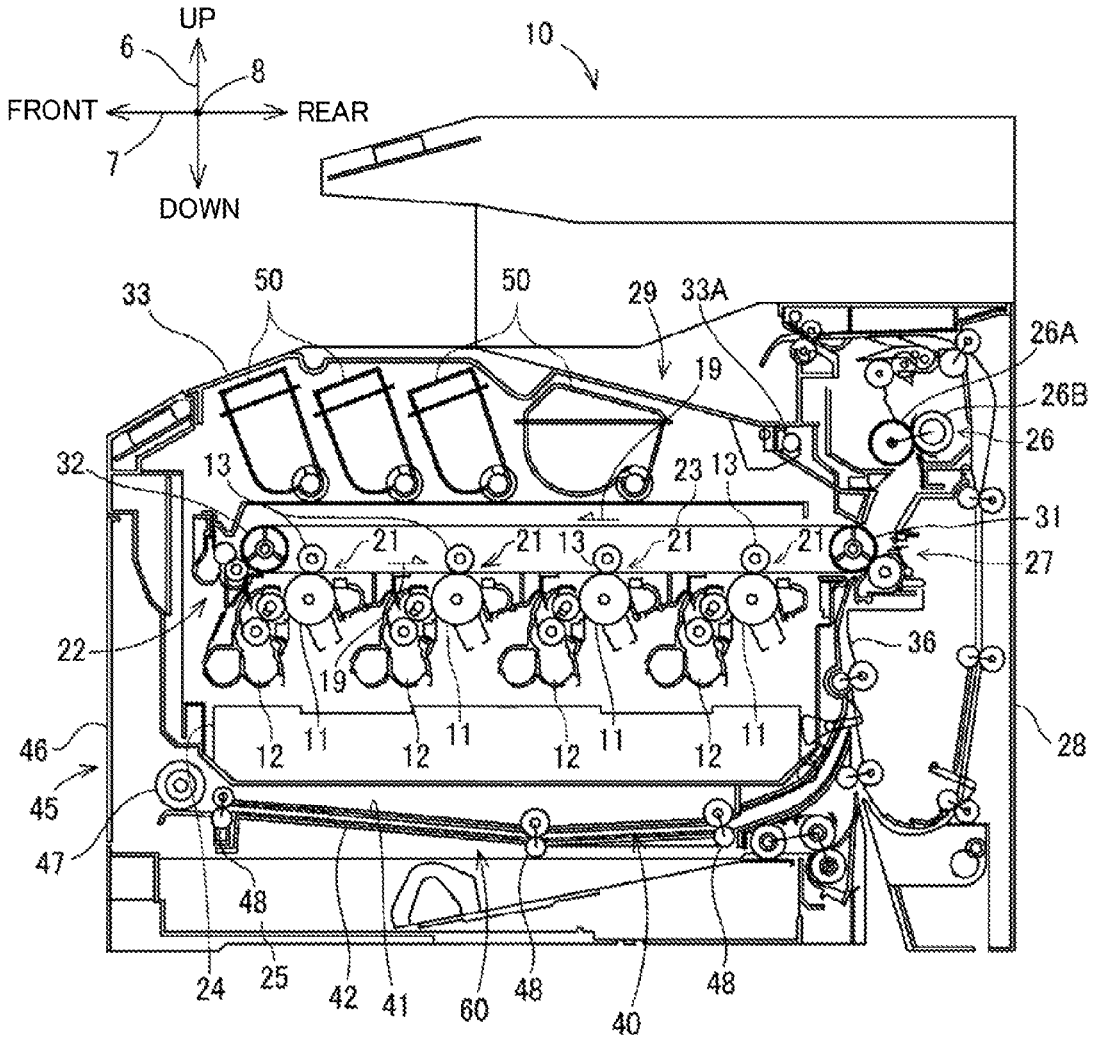
FIG. 1 is a diagram showing the configuration of an image forming apparatus according to an embodiment of the present disclosure.

Hereinafter, an embodiment of the present disclosure will be described with reference to the accompanying drawings. It should be noted that the following embodiment is an example embodying the present disclosure and does not limit the technical scope of the present disclosure. In addition, in the following description, an up-down direction 6 is defined in a state where an image forming apparatus 10 is installed on a flat support surface (a state shown in FIG. 1). A front-rear direction 7 is defined with the left side of the sheet surface of FIG. 1 as the front face side (front surface side) of the image forming apparatus 10. A right-left direction 8 (a direction perpendicular to the sheet surface of FIG. 1) is defined when the image forming apparatus 10 in FIG. 1 is seen from its front. Therefore, the near side with respect to the sheet surface of FIG. 1 is the right side of the image forming apparatus 10, and the depth side with respect to the sheet surface of FIG. 1 is the left side of the image forming apparatus 10.

The image forming apparatus 10 is a so-called tandem-type color printer. The image forming apparatus 10 prints an image on a sheet-like print paper (sheet member) by using a developer that contains toner.

As shown in FIG. 1, the image forming apparatus 10 mainly includes four image forming portions 21, an intermediate transfer unit 22, a sheet feed cassette 25, a fixing device 26, a secondary transfer device 27, a laser scanning unit 24, four toner containers 50, a cooling device 80 (see FIG. 3), a power supply control board 78 (see FIG. 3), and a sheet guide mechanism 60. These components are mounted in an apparatus main body 28 that serves as a housing forming an outer frame (not shown) and an inner frame (not shown) of the image forming apparatus 10, etc. In the apparatus main body 28, a partition plate 72 is provided at the left side thereof. By the partition plate 72, the internal space of the apparatus main body 28 is divided into a first space 72A at the left side surface 28A side of the apparatus main body 28 and a second space 72B at the right side surface 28B side of the apparatus main body 28. Here, the right side surface 28B corresponds to a first side surface of the present disclosure, and the left side surface 28A corresponds to a second side surface of the present disclosure.

The four image forming portions 21 are disposed within the apparatus main body 28 and below the intermediate transfer unit 22. Each image forming portion 21 performs an image forming process of forming an image on a print paper on the basis of so-called electrophotography. Specifically, each image forming portion 21 prints an image on a print paper on the basis of image data inputted externally via a network communication portion that is not shown. Each image forming portion 21 includes a photosensitive drum 11, a charging device (not shown), a developing device 12, and a primary transfer device 13, etc.

The intermediate transfer unit 22 is disposed above the image forming portions 21. A drive pulley 31 and a driven pulley 32 are provided at both ends, in the front-rear direction 7, of the intermediate transfer unit 22. A transfer belt 23 is supported so as to extend between and on the drive pulley 31 and the driven pulley 32. Accordingly, the transfer belt 23 extends in the front-rear direction 7 in a state where a belt surface thereof is horizontal. The transfer belt 23 is movable (can run) in the direction of an arrow 19 while the surface thereof is in contact with the surface of each photosensitive drum 11.

The secondary transfer device 27 transfers, onto a print paper, a toner image that has been transferred onto the transfer belt 23 and includes a plurality of colors. The print paper having the toner image transferred thereon is conveyed to the fixing device 26. The fixing device 26 fixes the toner image transferred onto the print paper, to the print paper by heat. The fixing device 26 includes a heating roller 26A that is heated to a high temperature, and a pressure roller 26B that is disposed so as to oppose the heating roller 26A. The print paper having conveyed to the fixing device 26 is conveyed while being nipped at a nip portion between the heating roller 26A and the pressure roller 26B by a predetermined biasing force, whereby the toner image is melted and adhered to the print paper. Thereafter, the print paper is discharged to a sheet discharge tray 29 provided at an upper portion of the apparatus main body 28.

The four toner containers 50 are disposed above the intermediate transfer unit 22. The four toner containers 50 are provided within the apparatus main body 28 so as to be arranged along the transfer belt 23 in a line along the front-rear direction 7. Each toner container 50 is configured to supply toner to the developing device 12 for a corresponding color.

The laser scanning unit 24 is provided below the image forming portions 21, specifically, between the image forming portions 21 and the sheet feed cassette 25. The laser scanning unit 24 includes laser light sources that emit laser light of respective colors, a polygon mirror 24A (see FIG. 2) as a scanning member that scans the laser light, a motor 24B (see FIG. 2) that rotationally drives the polygon mirror 24A, and a mirror that emits the scanned laser light, etc. The laser scanning unit 24 emits the laser light to the photosensitive drum 11 of each image forming unit 4 on the basis of inputted image data for each color. Accordingly, an electrostatic latent image is formed on each photosensitive drum 11.

Meanwhile, in a configuration in which a conveyance path 40 is formed below the laser scanning unit 24, a configuration may be adopted in which an air duct is provided between the laser scanning unit 24 and a conveyance path 30 for cooling the laser scanning unit 24. However, in the case where a reinforcing rib is provided to a conveyance guide forming the conveyance path 40, a space for disposing each of the reinforcing rib and the air duct is required, which inhibits compacting of the image forming apparatus 10. In particular, in the image forming apparatus 10 supporting a relatively large size such as A3-size sheets, the conveyance guide has to be reinforced by a reinforcing rib in order to prevent bending or the like of the conveyance guide. In the present embodiment, the provision of the sheet guide mechanism 60 in the image forming apparatus 10 makes it possible to achieve a high effect of cooling the laser scanning unit 24 while reinforcing an upper guide member 41 of the conveyance path 40, and makes it possible to make the apparatus size compact.

Hereinafter, the sheet guide mechanism 60 will be described. As shown in FIG. 1, the sheet guide mechanism 60 is provided between the laser scanning unit 24 and the sheet feed cassette 25. The sheet guide mechanism 60 includes the upper guide member 41 and a lower guide member 42. The upper guide member 41 is an example of a sheet guide of the present disclosure. The sheet guide mechanism 60 forms the conveyance path 40 (an example of a sheet conveyance path of the present disclosure) between the laser scanning unit 24 and the sheet feed cassette 25. That is, in the image forming apparatus 10, the conveyance path 40 is formed between the laser scanning unit 24 and the sheet feed cassette 25 by the sheet guide mechanism 60. The upper guide member 41 and the lower guide member 42 are provided below the laser scanning unit 24. The upper guide member 41 and the lower guide member 42 are disposed so as to oppose each other in the up-down direction 6 and be spaced apart from each other at a predetermined interval. The lower guide member 42 is provided below the upper guide member 41. A space between the upper guide member 41 and the lower guide member 42 is the conveyance path 40. That is, the conveyance path 40 is formed between the upper guide member 41 and the lower guide member 42. In the present embodiment, an upper guide surface of the conveyance path 40 is formed by the lower surface of the upper guide member 41. In addition, a lower guide surface of the conveyance path 40 is formed by the upper surface of the lower guide member 42. The upper guide member 41 extends in the front-rear direction 7 of the image forming apparatus 10 which is a direction along the bottom surface of the laser scanning unit 24, and the conveyance path 40 also extends in the same direction. A vertical conveyance path 36 is formed at the rear side of the image forming apparatus 10. The conveyance path 40 is connected to the vertical conveyance path 36 at the rear side.

At the front surface side of the image forming apparatus 10, a manual type sheet feed portion 45 is provided. The sheet feed portion 45 feeds a print paper via the conveyance path 40 and the vertical conveyance path 36 to the secondary transfer device 27 in the image forming apparatus 10. The sheet feed portion 45 includes a sheet receiving portion 46 (an example of a manual tray of the present disclosure) and a feeding portion 47. The sheet receiving portion 46 also serves as a cover for the front surface of the apparatus main body 28 of the image forming apparatus 10. The sheet receiving portion 46 is configured to be able to open/close an inlet of the conveyance path 40 with respect to the front surface of the apparatus main body 28. FIG. 1 shows a state where the sheet receiving portion 46 is closed with respect to the front surface of the apparatus main body 28. When the sheet receiving portion 46 is opened with respect to the front surface of the apparatus main body 28 such that the inner surface thereof faces upward, print papers having a predetermined size can be placed on the inner surface. The print papers placed on the sheet receiving portion 46 are fed to the conveyance path 40 by the feeding portion 47. On the conveyance path 40, a conveying roller pair 48 is provided, and the print paper in the conveyance path 40 is conveyed rearward by the conveying roller pair 48.

Figure 2:
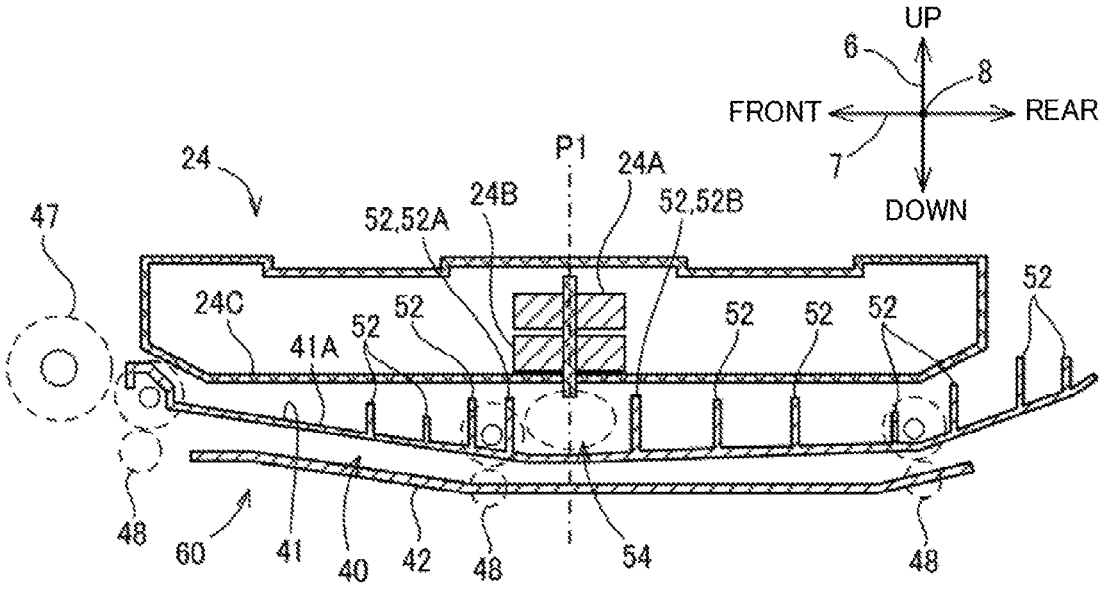
FIG. 2 is a diagram showing a conveyance path formed in the image forming apparatus.

As shown in FIG. 2, the upper guide member 41 includes a flat-plate-like base plate 41A (an example of a guide portion main body of the present disclosure) and a plurality of reinforcing ribs 52. The lower surface of the base plate 41A is a portion forming the upper guide surface of the conveyance path 40, and, on this lower surface, no member that inhibits conveyance of a print paper is provided. On the other hand, the plurality of reinforcing ribs 52 are integrally formed on the upper surface of the base plate 41A. Each reinforcing rib 52 extends in the right-left direction 8 along the bottom surface of the laser scanning unit 24. In other words, each reinforcing rib 52 extends in a direction orthogonal to a direction in which a print paper in the conveyance path 40 is conveyed. Each reinforcing rib 52 is provided on the upper surface of the base plate 41A in a standing manner, and is a thin-plate-like rib member projecting upward from the upper surface of the base plate 41A. All the reinforcing ribs 52 are provided so as to be parallel to each other. By the plurality of reinforcing ribs 52, the upper guide member 41 is reinforced, and further the conveyance path 40 is reinforced.

In the present embodiment, the motor 24B, which drives the polygon mirror 24A, is mounted on a bottom plate 24C of the laser scanning unit 24. The motor 24B is mounted at substantially the center of the bottom plate 24C. In addition, of the plurality of reinforcing ribs 52, a pair of reinforcing ribs 52A and 52B provided adjacently near the center of the laser scanning unit 24 are disposed so as to oppose each other across a position P1 at which the motor 24B is mounted. A space surrounded by the reinforcing ribs 52A and 52B is an air passage 54 through which air sent by a blower fan 81 described later flows. As shown in FIG. 2, the air passage 54 is formed below the position P1. That is, the reinforcing ribs 52 are not provided below the position P1. Specifically, the air passage 54 is a space surrounded, below the position P1, by the upper surface of the upper guide member 41 and the pair of reinforcing ribs 52A and 52B, which oppose each other in the front-rear direction 7.

Figure 3:
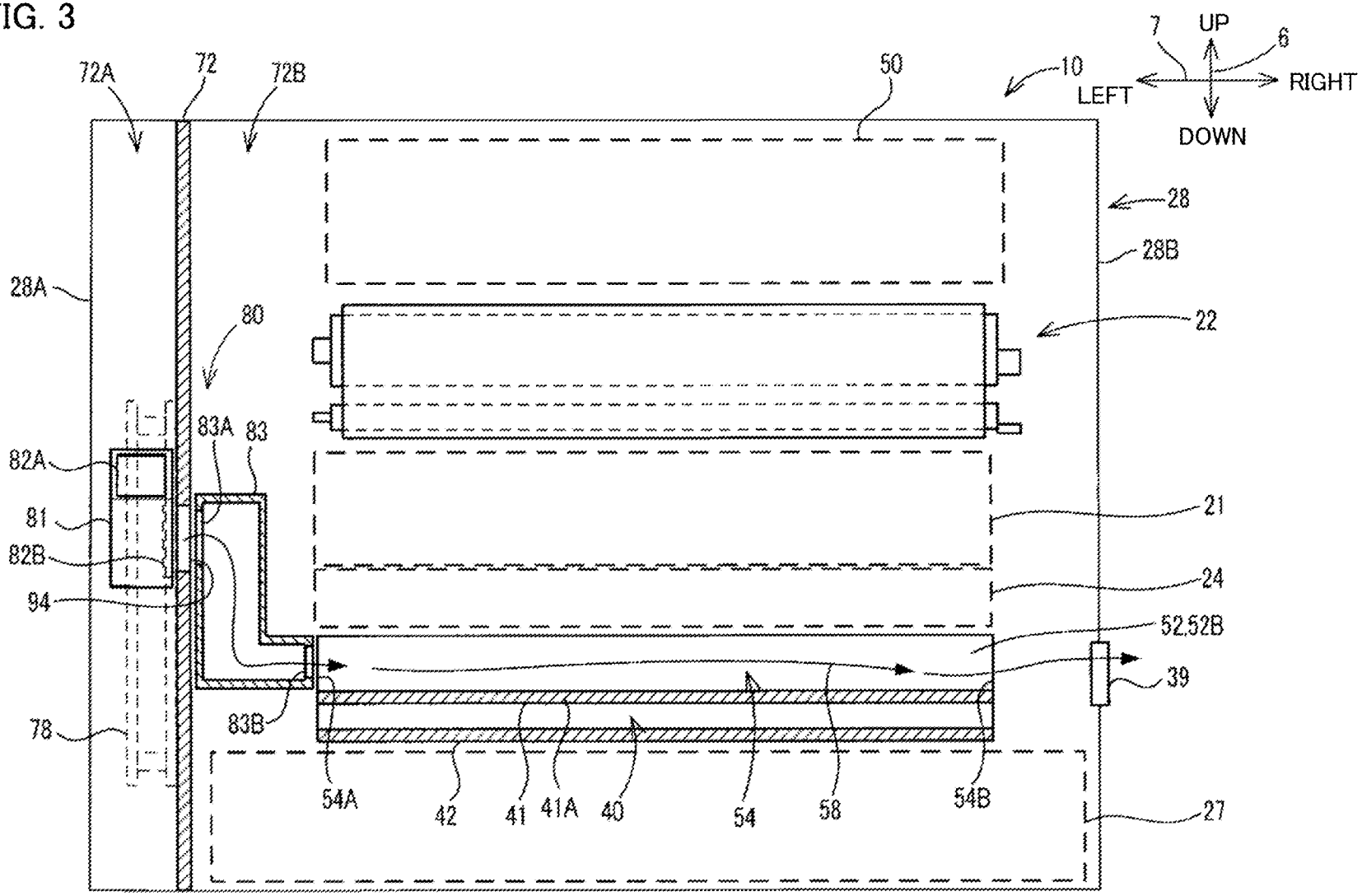
FIG. 3 is a diagram showing flow of air in the interior of the image forming apparatus.

FIG. 3 is a diagram showing flow of air in the interior of the image forming apparatus 10, and shows a cross-sectional structure of the laser scanning unit 24 when a vertical straight line passing through the position P1 is seen from the front side in FIG. 2. As shown in FIG. 3, the power supply control board 78 is provided in the first space 72A and is mounted on the left side surface of the partition plate 72. The power supply control board 78 converts commercial electric power to control power and driving power to be used in the image forming apparatus 10, and supplies the control power and the driving power to each portion, and is a board on which electronic devices such as an electrolytic capacitor, a coil, a converter (e.g., an AC/DC converter), and a transformer that steps up or down a voltage are mounted. Thus, when the power supply control board 78 is energized, each electronic device thereof generates heat to be a heat source, and hence the power supply control board 78 needs to be cooled. The power supply control board 78 is not limited to one for controlling a power supply voltage, and may include a calculation portion for controlling operation of the image forming apparatus 10 and a drive circuit such as a motor driver.

The cooling device 80 cools the interior of the image forming apparatus 10, particularly, cools the laser scanning unit 24 and the power supply control board 78 as internal devices. In the present embodiment, the cooling device 80 includes the blower fan 81 (an example of an air blower of the present disclosure) and a duct portion 83. The blower fan 81 is provided within the apparatus main body 28 and at the left side surface 28A side. Specifically, the blower fan 81 is provided in the first space 72A and is mounted on the left side surface of the partition plate 72. The duct portion 83 is provided in the second space 72B and is mounted on the right side surface of the partition plate 72.

In the partition plate 72, a communication port 94 is formed. The blower fan 81 has a suction port 82A facing the first space 72A, and a blowing port 82B connected hermetically to the communication port 94. As described later, the blower fan 81 sends air through the duct portion 83 to the air passage 54. The duct portion 83 conveys the air sent from the blower fan 81, to the air passage 54, and has an opening 83A connected to the communication port 94, and an opening 83B opposed to an air port 54A of the air passage 54 at the left side. The duct portion 83 blows the air entering the opening 83A from the blower fan 81, through the opening 83B to guide the air to the air port 54A.

As shown in FIG. 3, an exhaust port 39 (an example of a discharge port of the present disclosure) is provided in the right side surface 28B of the apparatus main body 28. The exhaust port 39 is provided in the right side surface 28B and at a position at which the right side surface 28B intersects the direction in which the air passage 54 extends. That is, the exhaust port 39 is formed in the right side surface 28B and at a position opposing an air port 54B of the air passage 54 at the right side.

In the cooling device 80, the blower fan 81 is driven constantly or at required timing. Since the cooling device 80 cools the laser scanning unit 24 and the power supply control board 78, the cooling device 80 is controlled to be driven, for example, during a period when there is concern for an increase in the temperatures of the laser scanning unit 24 and the power supply control board 78, specifically, during a period from start of image formation to end of the image formation, or during a period from start of image formation to elapse of a predetermined time period after end of the image formation.

As shown in FIG. 3, when the blower fan 81 is driven, the air in the first space 72A is sucked and blown through the communication port 94, the opening 83A, the duct portion 83, and the opening 83B to the second space 72B. The opening 83B is positioned such that the air is sent therefrom to the air passage 54. Thus, the air blown from the opening 83B flows through the air passage 54 between the reinforcing ribs 52A and 52B in the direction of an arrow 58. Then, the air is discharged to the outside through the exhaust port 39, which is provided in the right side surface 28B of the apparatus main body 28. Since the air in the first space 72A is sucked by the blower fan 81 as described above, the pressure in the first space 72A becomes negative due to the air around the power supply control board 78 being sucked, so that outside air enters the first space 72A through a gap in the apparatus main body 28. Accordingly, the power supply control board 78 is cooled. In addition, the air blown to the air passage 54 moves in the air passage 54 rightward along the arrow 58. During the movement of the air, the air comes into contact with the bottom plate 24C of the laser scanning unit 24 to cool the bottom plate 24C. Moreover, by the air flowing through the air passage 54, floating matter such as floating toner is discharged together with the air to the outside through the exhaust port 39.

Particularly, since the air flows through the air passage 54 between the reinforcing ribs 52A and 52B in the direction of the arrow 58, heat of the motor 24B, which is mounted at the position P1, is effectively cooled through the bottom plate 24C. Accordingly, it is possible to suppress an increase in the temperatures of the laser scanning unit 24, the power supply control board 78, and the like, and also to discharge floating matter such as floating toner to the outside from the image forming apparatus 10.

As described above, in the present embodiment, the reinforcing ribs 52 of the upper guide member 41 also serve as a duct for cooling, and thus it is not necessary to individually provide a duct and the reinforcing ribs 52. Accordingly, the image forming apparatus 10 can be made compact in the up-down direction 6. In addition, since the upper guide member 41 is configured as described above, the conveyance path 40 can be reinforced within the image forming apparatus 10, and an air duct between the upper guide member 41 and the laser scanning unit 24 can be eliminated to achieve space saving.

In the above embodiment, the configuration has been described in which the air in the first space 72A is sucked and sent to the air passage 54 in the second space 72B. However, the present disclosure is not limited to this configuration. In the above configuration, the air around the power supply control board 78 is warmed by the power supply control board 78, and thus the effect of cooling the laser scanning unit 24 may be diminished when this air is used. Thus, the blower fan 81 may be provided so as to suck outside air and blow the outside air to the air passage 54. In addition, in the above embodiment, the configuration has been described in which air is discharged through the exhaust port 39. However, for example, air may be sucked through the exhaust port 39, caused to flow into the air passage 54, and discharged through the duct portion 83 from the second space 72B to the first space 72A.

In the above embodiment, the configuration has been illustrated in which air is blown through the duct portion 83 to the air passage 54 between the reinforcing ribs 52A and 52B. However, for example, the duct portion 83 may not be provided, and the blower fan 81 may be provided at such a position that the blowing port 82B faces the air passage 54. In addition, the configuration has been illustrated in which air is blown only to the air passage 54, but air may be sent to each of spaces between the respective reinforcing ribs 52 to cool the entire bottom plate 24C.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a laser scanning unit;

an upper guide member provided below the laser scanning unit and forming an upper guide surface of a sheet conveyance path extending in a direction along a bottom surface of the laser scanning unit;

a plurality of reinforcing ribs provided on an upper surface of the upper guide member and extending in a predetermined direction; and an air blower configured to send air to a space between the plurality of adjacent reinforcing ribs.

2. The image forming apparatus according to claim 1, wherein a motor is provided on a bottom plate of the laser scanning unit and configured to drive a scanning member, and of the plurality of reinforcing ribs, a pair of reinforcing ribs are provided on the upper surface of the upper guide member such that a motor position at which the motor is provided is located therebetween.

3. The image forming apparatus according to claim 2, wherein the plurality of reinforcing ribs extend in an orthogonal direction orthogonal to a direction in which a sheet member in the sheet conveyance path is conveyed.

4. The image forming apparatus according to claim 3, wherein an air passage is formed below the motor position so as to be surrounded by the upper surface of the upper guide member and the pair of reinforcing ribs and extend in the orthogonal direction.

5. The image forming apparatus according to claim 4, wherein a discharge port is provided in a first side surface of a housing of the image forming apparatus and at a position at which the first side surface intersects the direction in which the air passage extends, the air blower is provided in the housing and at a second side surface side opposite to the first side surface, and the image forming apparatus further comprises a duct portion configured to guide the air sent from the air blower, to an air port of the air passage at the second side surface side.

6. The image forming apparatus according to claim 5, further comprising a partition plate provided within the housing so as to divide an internal space of the housing into a space at the first side surface side and a space at the second side surface side, wherein the air blower is provided in the space at the first side surface side, the laser scanning unit, the upper guide member, and the duct portion are provided in the space at the second side surface side, and a communication port is formed in the partition plate so as to pass the air sent from the air blower, to the duct portion.

7. The image forming apparatus according to claim 6, wherein the duct portion is mounted on a surface of the partition plate at the first side surface side.

8. The image forming apparatus according to claim 5, wherein the discharge port is provided in the first side surface and at a position opposing an air port of the air passage at the first side surface side.

9. The image forming apparatus according to claim 1, further comprising a lower guide member provided below the upper guide member so as to form the sheet conveyance path between the upper guide member and the lower guide member.

10. The image forming apparatus according to claim 1, further comprising:

a manual tray provided at a side surface of the apparatus main body; and a feeding portion configured to feed a sheet member placed on the manual tray, to the sheet conveyance path.

11. A sheet guide comprising:

a flat-plate-like guide portion main body provided within an image forming apparatus and below a laser scanning unit, the guide portion main body forming an upper guide surface of a sheet conveyance path extending in a direction along a bottom surface of the laser scanning unit; and a plurality of reinforcing ribs provided on an upper surface of the guide portion main body in a standing manner, the plurality of reinforcing ribs reinforcing the guide portion main body and forming an air passage extending in a predetermined direction.

* * * * *